US007452059B2

(12) United States Patent
Mataki

(10) Patent No.: US 7,452,059 B2
(45) Date of Patent: Nov. 18, 2008

(54) LIQUID EJECTION APPARATUS

(75) Inventor: Hiroshi Mataki, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 435 days.

(21) Appl. No.: 11/237,955

(22) Filed: Sep. 29, 2005

(65) Prior Publication Data

US 2006/0071960 A1 Apr. 6, 2006

(30) Foreign Application Priority Data

Sep. 30, 2004 (JP) ..... 2004-288783

(51) Int. Cl.
*B41J 2/045* (2006.01)

(52) U.S. Cl. ..... 347/68; 347/57; 347/54; 347/10

(58) Field of Classification Search ..... 347/9–11, 347/57, 68

See application file for complete search history.

(56) References Cited

U.S. PATENT DOCUMENTS 6,382,754 B1 * 5/2002 Morikoshi et al. ..... 347/11
6,799,821 B1 * 10/2004 Okuda ..... 347/10
6,962,398 B2 * 11/2005 Okuda et al. ..... 347/10

FOREIGN PATENT DOCUMENTS

JP 9-226106 A 9/1997

* cited by examiner

*Primary Examiner*—Matthew Luu
*Assistant Examiner*—Henok Legesse
(74) *Attorney, Agent, or Firm*—Birch, Stewart, Kolasch & Birch, LLP

(57) ABSTRACT

The liquid ejection apparatus comprises: a nozzle through which liquid is ejected; a pressure chamber which accommodates the liquid to be ejected from the nozzle; a supply side flow path which fills the liquid from a supply system into the pressure chamber; an actuator which is provided on at least one wall of the pressure chamber and changes a volume of the pressure chamber; and a drive signal generating device which generates a drive signal including at least a first drive signal having a time period T1 which drives the actuator so as to expand the pressure chamber, and a second drive signal having a time period T2 which drives the actuator so as to contract the pressure chamber, wherein: a relationship between the time period T2 of the second drive signal and a Helmholtz period Tc of the pressure chamber satisfies $T2 \leqq Tc/2$; and when the actuator is operated by means of the drive signal to generate, in the nozzle, a pressure having a prescribed cycle in which a negative pressure acting in a direction which causes the pressure chamber to expand, and a positive pressure acting in a direction which causes the pressure chamber to contract arise alternately, a relationship between an absolute value of a first negative pressure Pn1 generated initially from a static meniscus state of the liquid in the nozzle and an absolute value of a second negative pressure Pn2 generated one cycle after the first negative pressure, satisfies $|Pn1| \leqq |Pn2|$.

6 Claims, 9 Drawing Sheets

LIQUID EJECTION APPARATUS

BACKGROUND OF THE INVENTION

1. Field of the Invention

The present invention relates to a liquid ejection apparatus, and more particularly, to a technology and structure for controlling the ejection of a liquid ejection head which ejects liquid onto an ejection receiving medium.

2. Description of the Related Art

An inkjet recording apparatus having an inkjet type of print head forms a desired image on a medium by ejecting ink from a plurality of nozzles provided in the print head. There are inkjet recording apparatuses which comprise actuators provided in the pressure chambers which accommodate ink to be ejected from the nozzles, and cause ink to be ejected from the nozzles by causing the pressure chambers to expand and contract. In a method of this kind, various means are devised for utilizing the resonance effect of the pressure wave generated in the pressure chamber in order to perform ejection and refilling at high speed.

In the inkjet recording apparatus described in Japanese Patent Application Publication No. 9-226106, a first signal for causing a pressure generating chamber to expand is applied for a time period shorter than the period of the Helmholtz resonance frequency, and a second signal for holding the expanded state of the pressure generating chamber is applied for a time period of ½ or less of the Helmholtz period, whereby the vibration of the meniscus is reduced to a minimum and small ink droplets having reduced smearing due to satellite drops can be ejected stably at a high frequency.

However, in the inkjet recording apparatus described in Japanese Patent Application Publication No. 9-226106, a third signal for ejecting ink from the nozzles is applied for a time period equal to or above the Helmholtz period, and therefore, the time taken to perform one ejection becomes longer and consequently, the ejection time period cannot be shortened. In particular, at the viscosity of generally used inks, the residual vibration of the pressure wave generated after ejection is not attenuated, and the third signal is applied for a time period equal to or above the Helmholtz period in order to attenuate the residual vibration of the pressure wave.

SUMMARY OF THE INVENTION

The present invention has been contrived in view of these circumstances, an object thereof being to provide a liquid ejection apparatus which achieves desirable ejection of high-viscosity ink, at high speed, by utilizing the resonance effects of the pressure chamber.

In order to attain the aforementioned object, the present invention is directed to a liquid ejection apparatus, comprising: a nozzle through which liquid is ejected; a pressure chamber which accommodates the liquid to be ejected from the nozzle; a supply side flow path which fills the liquid from a supply system into the pressure chamber; an actuator which is provided on at least one wall of the pressure chamber and changes a volume of the pressure chamber; and a drive signal generating device which generates a drive signal including at least a first drive signal having a time period T1 which drives the actuator so as to expand the pressure chamber, and a second drive signal having a time period T2 which drives the actuator so as to contract the pressure chamber, wherein: a relationship between the time period T2 of the second drive signal and a Helmholtz period Tc of the pressure chamber satisfies $T2 \leqq Tc/2$; and when the actuator is operated by means of the drive signal to generate, in the nozzle, a pressure having a prescribed cycle in which a negative pressure acting in a direction which causes the pressure chamber to expand, and a positive pressure acting in a direction which causes the pressure chamber to contract arise alternately, a relationship between an absolute value of a first negative pressure Pn1 generated initially from a static meniscus state of the liquid in the nozzle and an absolute value of a second negative pressure Pn2 generated one cycle after the first negative pressure, satisfies $|Pn1| \leqq |Pn2|$.

According to the present invention, in the drive signal that is supplied to the actuator, the time period T2 of the second drive signal which causes the actuator to operate in a direction that contacts the expanded pressure changer is ½ or less of the Helmholtz period Tc of the pressure chamber, and therefore, a superimposition effect occurs in the pressure waveform during pull-push driving and the relationship between the absolute value of the first negative pressure Pn1 occurring initially after the static state of the meniscus surface and the absolute value of the second negative pressure Pn2 occurring one cycle after the first negative pressure satisfies $|Pn1| \leqq |Pn2|$. Accordingly, it is possible to obtain a stable ejection force by severing (pulling back) the liquid column in a reliable fashion.

The drive signal may also include a drive signal which maintains the expanded state of the pressure chamber due to the first drive signal. In other words, the drive signal may comprise a first drive signal and a second drive signal, and have a triangular voltage waveform, or it may comprise a first drive signal, a second drive signal and a third drive signal, and have a rectangular-shaped voltage waveform.

The ejection head may be a full line type head in which ejection holes are arranged through a length corresponding to the entire width of the ejection receiving medium, or a serial type head (shuttle scanning type head) in which a short head having ejection holes arranged through a length that is shorter than the entire width of the ejection receiving medium ejects recording liquid onto the ejection receiving medium while scanning in the breadthways direction of the ejection receiving medium.

A full line ejection head may be formed to a length corresponding to the full width of the recording medium by combining short head having rows of ejection holes which do not reach a length corresponding to the full width of the ejection receiving medium, these short heads being joined together in a staggered matrix fashion.

Preferably, a relationship between the absolute value of the first negative pressure Pn1, and an absolute value of a second positive pressure Pp2 generated after the second negative pressure by a half of the prescribed cycle, satisfies $|Pn1| \geqq |Pp2|$.

Since the relationship between the absolute value of the first negative pressure Pn1 and the absolute value of the second positive pressure Pp2 generated ½ cycle after the second negative pressure satisfies $|Pn1| \geqq |Pp2|$, then it is possible to stabilize the meniscus rapidly after ejection of liquid and therefore, the meniscus stabilization time can be reduced. Furthermore, no drive signal is required in order to stabilize the meniscus, and therefore, the drive signal has a simple waveform.

Preferably, the drive signal includes a third drive signal having a time period T3 which maintains an expanded state of the pressure chamber; and a relationship between the time period T1 of the first drive signal, the time period T2 of the second drive signal, the time period T3 of the third drive signal, and the Helmholtz period Tc of the pressure chamber, satisfies $T1+T2+T3 \leqq Tc/2$.

By setting the whole of the time period of the drive signal to ½ or less of the Helmholtz period Tc of the pressure chamber, it is possible to shorten the operation time period of the actuator and to shorten the ejection cycle (in other words, to increase the ejection frequency).

Preferably, the drive signal includes a third drive signal having a time period T3 which maintains an expanded state of the pressure chamber; and a relationship between the time period T1 of the first drive signal, the time period T3 of the third drive signal, and the Helmholtz period Tc of the pressure chamber, satisfies T1+T3≦Tc/2.

By setting the time period T2 of the second drive signal to zero (in other words, making an instantaneous voltage change in the drive signal for contracting the pressure chamber from its expanded state), it is possible to sever the liquid column in a reliable fashion during liquid ejection, and therefore, the liquid droplet ejection volume is further stabilized and the effect in prevent satellite droplets and trailing is further enhanced.

Preferably, the drive signal includes a third drive signal having a time period T3 which maintains an expanded state of the pressure chamber; and a relationship between the time period T3 of the third drive signal, and the Helmholtz period Tc of the pressure chamber, satisfies T3≦Tc/2.

By setting the time period T1 of the first drive signal and the time period T2 of the second drive signal both to zero (in other words, making an instantaneous voltage change in the drive signal for expanding the pressure chamber from a static state and the drive signal for contracting the pressure chamber from an expanded state), the voltage waveform of the drive signal becomes a square wave. Therefore, not only is the waveform of the drive signal simplified, but furthermore, it also becomes possible to shorten the ejection cycle yet further.

In other words, if the voltage waveform of the drive signal is set to be a square wave, then the relationship between the time period T3 of the third drive signal and the Helmholtz frequency of the pressure chamber will be T3≦Tc/2.

Preferably, the liquid of high viscosity is ejected from the nozzle.

Preferably, the following relationship is satisfied:

$$\frac{\left(\frac{0.4811}{\pi}\right)^2 \times \frac{\rho}{\ln \times As + ls \times An}}{\left\{1 + \left(\frac{0.4811}{\pi}\right)^2\right\} \times \left(\frac{V}{\rho \times c^2} + \frac{X}{P}\right)} \geq \frac{2 \times \pi \times v}{\ln \times As^2 + ls \times An^2} \geq \frac{\left(\frac{0.2813}{\pi}\right)^2 \times \frac{\rho}{\ln \times As + ls \times An}}{\left\{1 + \left(\frac{0.2813}{\pi}\right)^2\right\} \times \left(\frac{V}{\rho \times c^2} + \frac{X}{P}\right)},$$

where ln is a length of the nozzle; An is a surface area of the nozzle; ls is a length of the supply side flow path; As is a surface are of the supply side flow path; ρ is a density of the liquid; v is a viscosity of the liquid; c is a speed of sound in the liquid; V is a removed volume of the liquid accommodated in the pressure chamber when a pressure P is generated by the actuator; and X is a removed volume of total of a volume of the liquid ejected from the nozzle, a volume of the liquid returning to the supply side flow path, and a volume of the liquid compressed due to application of the pressure P.

By composing a liquid ejection head in such a manner the above-described formula is satisfied, it is possible to suppress residual vibration of the meniscus occurring after ejection of the liquid, and therefore, desirable ejection can be achieved at a high ejection frequency, by using a simple drive signal comprising a pull-push action only. Beneficial effects are displayed in particular in the case of a high-viscosity liquid having a viscosity of 10 cP or above.

According to the present invention, in driving ejection of a liquid by operating an actuator in such a manner that a pressure chamber repeats an action of expanding and contracting, since the time period T2 of the second drive signal which causes the pressure chamber to contract after it has expanded, in the drive signal supplied to the actuator, is equal to or less than ½ of the Helmholtz frequency Tc of the pressure chamber, then in the pressure wave generated in the nozzle section, the absolute value of the pressure Pn2 of the second negative pressure generated one cycle after the first negative pressure will be greater than the absolute value of the pressure Pn1 of the first negative pressure generated when the pressure chamber expands, and therefore the liquid column can be severed reliably when ejecting liquid and a very small amount of liquid can be ejected reliably.

Furthermore, if the absolute value of the pressure Pp2 of the second positive pressure generated ½ cycle after the second negative pressure is smaller than the absolute value of the pressure Pn1 of the first negative pressure, then vibration of the meniscus is suppressed and the ejection cycle can be shortened.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
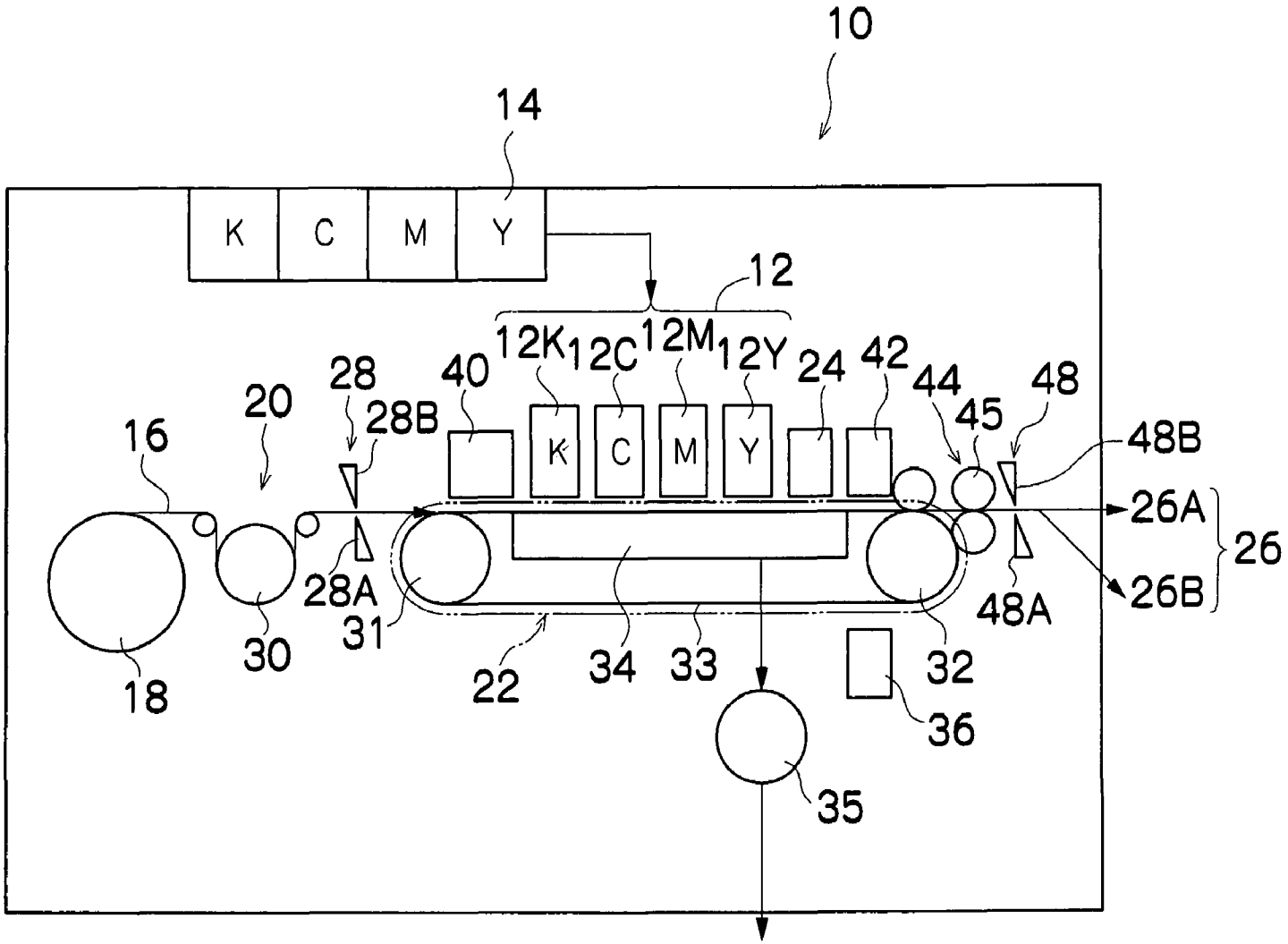
FIG. 1 is a general schematic drawing of an inkjet recording apparatus using an image processing apparatus according to an embodiment of the present invention.

FIG. 1 is a diagram of the general composition of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16 supplied from the paper supply unit 18; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an example of the paper supply unit 18; however, a plurality of magazines with papers of different paper width and quality may be jointly provided. Moreover, papers may be supplied in cassettes that contain cut papers loaded in layers and that are used jointly or in lieu of magazines for rolled papers.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink droplet ejection is controlled so that the ink droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite to the curl direction in the magazine. In this, the heating temperature is preferably controlled in such a manner that the recording paper 16 has a curl in which the surface on which the print is to be made is slightly rounded in the outward direction.

In the case of the configuration in which roll paper is used, a cutter (a first cutter) 28 is provided as shown in FIG. 1, and the continuous paper is cut into a desired size by the cutter 28. The cutter 28 has a stationary blade 28A, of which length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the side adjacent to the printed surface across the conveyance path. When cut paper is used, the cutter 28 is not required.

After decurling in the decurling unit 24, the cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and this suction chamber 34 provides suction with a fan 35 to generate a negative pressure, thereby holding the recording paper 16 onto the belt 33 by suction.

The belt 33 is driven in the clockwise direction in FIG. 1 by the motive force of a motor 88 (not shown in FIG. 1, but shown in FIG. 5) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the linear velocity of the cleaning roller different to that of the belt 33, in order to improve the cleaning effect.

Instead of a suction belt conveyance unit 22, it might also be possible to use a roller nip conveyance mechanism, but since the print region passes through the roller nip, the printed surface of the paper makes contact with the rollers immediately after printing, and hence smearing of the image is liable to occur. Therefore, a suction belt conveyance mechanism in which nothing comes into contact with the image surface in the printing area is preferable.

A heating fan 40 is provided on the upstream side of the print unit 12 in the paper conveyance path formed by the suction belt conveyance unit 22. This heating fan 40 blows heated air onto the recording paper 16 before printing, and thereby heats up the recording paper 16. Heating the recording paper 16 before printing means that the ink will dry more readily after landing on the paper.

Figure 2:
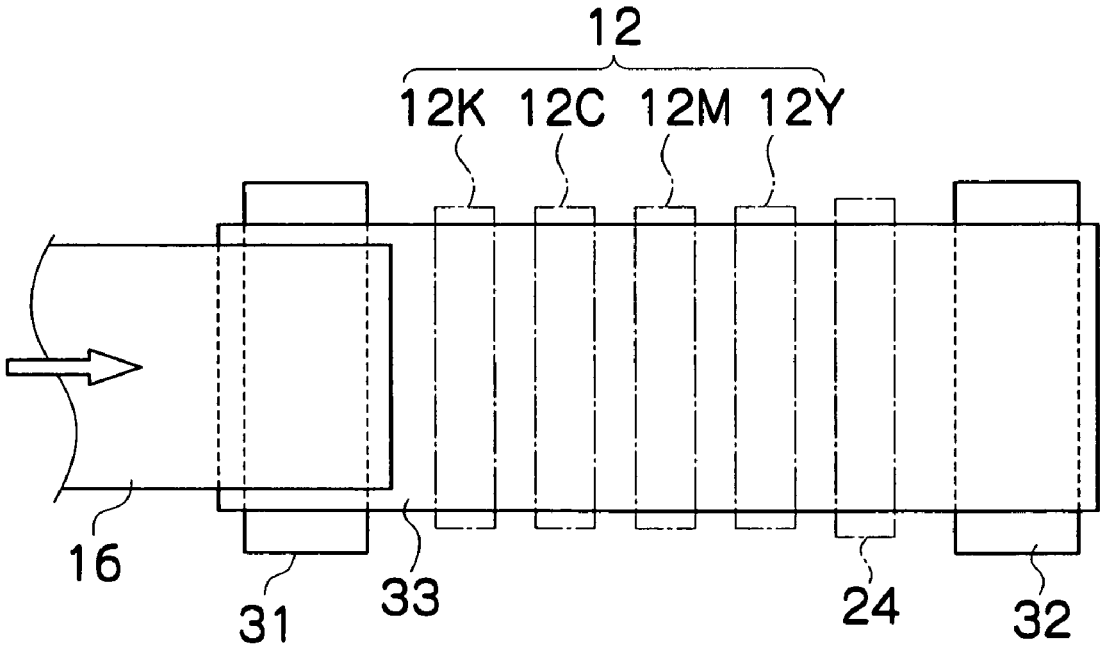
FIG. 2 is a plan view of the principal part of the peripheral area of a print unit in the inkjet recording apparatus shown in FIG. 1.

The print unit 12 is a so-called "full line head" in which a line head having a length corresponding to the maximum paper width is arranged in a direction (main scanning direction) that is perpendicular to the paper feed direction (see FIG. 2). An example of the detailed structure is described below (in FIGS. 3A to 3C and FIG. 5), but each of the print heads 12K, 12C, 12M, and 12Y is constituted by a line head, in which a plurality of ink ejection ports (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in the order of black (K), cyan (C), magenta (M), and yellow (Y) from the upstream side, following the feed direction of the recording paper 16 (hereinafter, referred to as the sub-scanning direction). A color print can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (in other words, by means of a single sub-scan). Higher-speed printing is thereby made possible and productivity can be improved in comparison with a shuttle type head configuration in which a print head moves reciprocally in the main scanning direction.

Although a configuration with four standard colors, K M C and Y, is described in the present embodiment, the combinations of the ink colors and the number of colors are not limited to these, and light and/or dark inks can be added as required.

For example, a configuration is possible in which print heads for ejecting light-colored inks such as light cyan and light magenta are added.

As shown in FIG. 1, the ink storing and loading unit 14 has tanks for storing inks of the colors corresponding to the respective print heads 12K, 12C, 12M and 12Y, and each tank is connected to a respective print head 12K, 12C, 12M, 12Y, via a tube channel (not shown). The ink storing and loading unit 14 also comprises a warning device (for example, a display device or an alarm sound generator) for warning when the remaining amount of any ink is low, and has a mechanism for preventing loading errors among the colors.

The print determination unit 24 has an image sensor for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width of the print heads 12K, 12C, 12M, and 12Y This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of Head

Figure 3A:
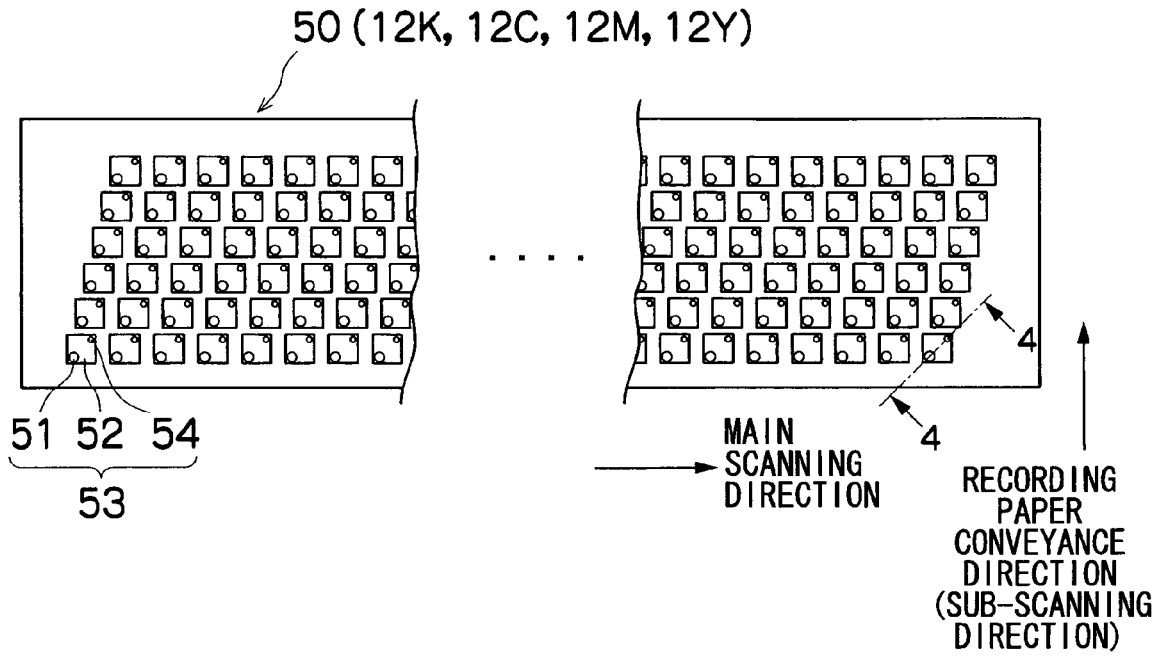
FIGS. 3A to 3C are plan perspective diagrams showing the composition of a print head in the inkjet recording apparatus shown in FIG. 1.
Figure 3B:
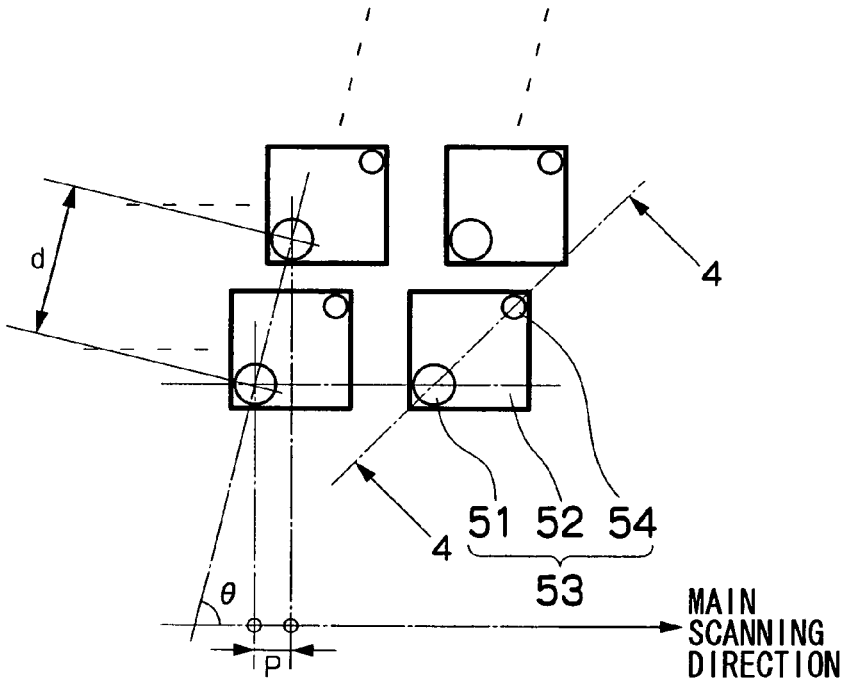
Figure 3C:
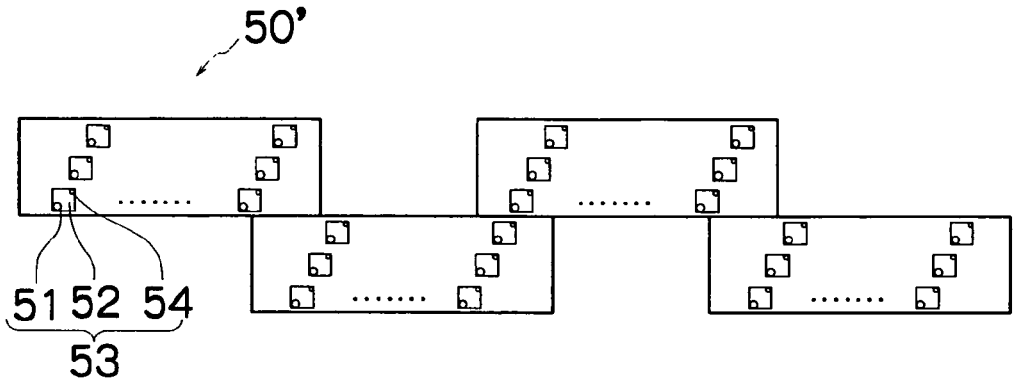
Figure 4:
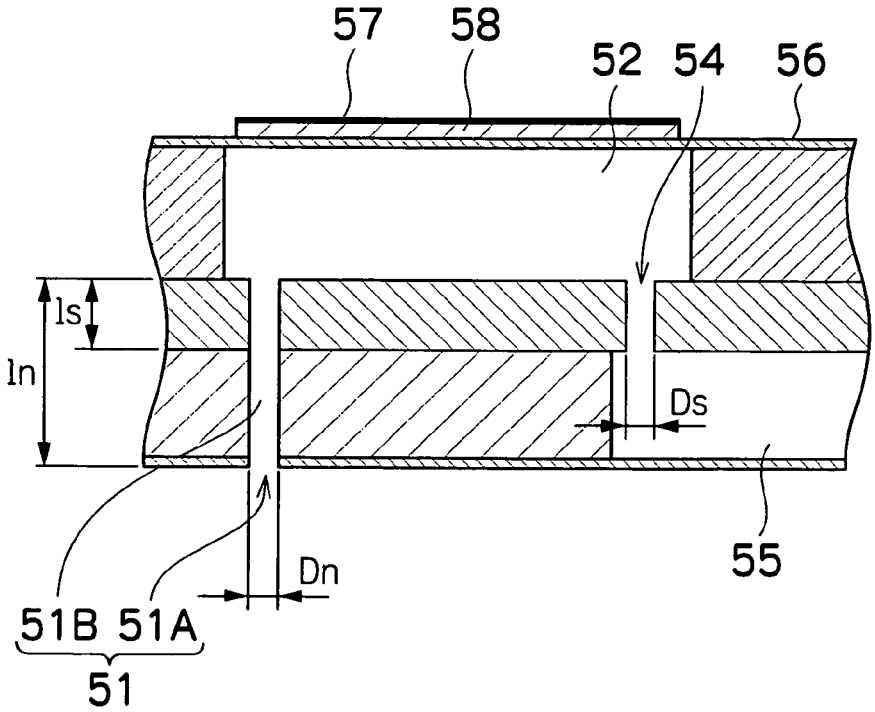
FIG. 4 is a diagram showing the three-dimensional structure of the print head shown in FIGS. 3A to 3C.

Next, the structure of a print head will be described. The print heads 12K, 12C, 12M and 12Y provided for the respective ink colors have the same structure, and a reference numeral 50 is hereinafter designated to any of the print heads 12K, 12C, 12M and 12Y. FIG. 3A is a plan view perspective diagram showing an example of the composition of a print head 50, and FIG. 3B is an enlarged diagram of a portion of same. Furthermore, FIG. 3C is a plan view perspective diagram showing a further example of the composition of a print head 50, and FIG. 4 is a cross-sectional diagram showing a three-dimensional composition of an ink chamber unit (being a cross-sectional view along line 4-4 in FIG. 3A). In order to achieve a high density of the dot pitch printed onto the surface of the recording medium, it is necessary to achieve a high density of the nozzle pitch in the print head 50. As shown in FIGS. 3A to 3C and FIG. 4, the print head 50 in the present embodiment has a structure in which a is plurality of ink chamber units 53 including nozzles 51 for ejecting ink droplets and pressure chambers 52 connecting to the nozzles 51 are disposed in the form of a staggered matrix, and the effective nozzle pitch is thereby made small.

More specifically, as shown in FIGS. 3A and 3B, the print head 50 according to the present embodiment is a full-line head having one or more nozzle rows in which a plurality of nozzles 51 for ejecting ink are arranged along a length corresponding to the entire width (printable width) of the recording medium in a direction substantially perpendicular to the conveyance direction of the print medium (recording paper 16).

Moreover, as shown in FIG. 3C, it is also possible to use respective print heads 50' of nozzles arranged to a short length in a two-dimensional fashion, and to combine same in a zigzag arrangement, whereby a length corresponding to the full width of the print medium is achieved.

The pressure chamber 52 provided corresponding to each of the nozzles 51 is substantially square-shaped in plan view, and a nozzle 51 and an ink supply port 54 are provided respectively at either corner of a diagonal of the pressure chamber 52. Each pressure chamber 52 is connected via an ink supply port 54 to a common ink chamber (common flow channel) 55.

The planar shape of the pressure chamber 52 is not limited to a substantial square shape, and for example, it may be a rectangular shape, a diamond shape, or a parallelogram shape, or it may be a non-quadrilateral shape, such as a polygonal shape, a circular shape, an elliptical shape, or the like.

An actuator 58 (pressurizing device) provided with an individual electrode 57 is bonded to a pressure plate 56 (a diaphragm that also serves as a common electrode) which forms the ceiling of the pressure chamber 52. When a drive voltage is applied to the individual electrode 57, the actuator 58 is deformed, the volume of the pressure chamber 52 is thereby changed, and the pressure in the pressure chamber 52 is thereby changed, so that the ink inside the pressure chamber 52 is thus ejected through the nozzle 51. The actuator 58 is preferably a piezoelectric element. When ink is ejected, new ink is supplied to the pressure chamber 52 from the common ink chamber 55 through the ink supply port 54.

As shown in FIG. 4, each of the nozzles 51 provided in the print head 50 has a composition comprising a nozzle opening section 51A and an ejection side flow channel 51B which connects the pressure chamber 52 with the nozzle opening section 51A, and the diameter of the nozzle opening section is taken to be Dn, the diameter of the ejection side flow channel 51B is taken to be Dn (the same as the diameter of the nozzle opening section 51A), and the length of the flow channel is taken to be ln. The vicinity of the nozzle opening section 51A may be formed into a tapered shape, and the ejection side flow channel 51B may be formed by combining a plurality of flow channels (tube channels) having different diameters.

Furthermore, the ink supply port 54 which connects the pressure chamber 52 and the common ink chamber 55 has a circular column shape of diameter Ds and flow channel length ls, as shown in FIG. 4.

As shown in FIG. 3B, the plurality of ink chamber units 53 having this structure are composed in a lattice arrangement, based on a fixed arrangement pattern having a row direction which coincides with the main scanning direction, and a column direction which, rather than being perpendicular to the main scanning direction, is inclined at a fixed angle of θ with respect to the main scanning direction. By adopting a structure wherein a plurality of ink chamber units 53 are arranged at a uniform pitch d in a direction having an angle θ with respect to the main scanning direction, the pitch P of the nozzles when projected to an alignment in the main scanning direction will be d×cos θ.

More specifically, the arrangement can be treated equivalently to one in which the respective nozzles 51 are arranged in a linear fashion at a uniform pitch P, in the main scanning direction. By means of this composition, it is possible to achieve a nozzle composition of high density, wherein the nozzle columns projected to an alignment in the main scanning direction reach a total of 2400 per inch (2400 nozzles per inch). Below, in order to facilitate the description, it is supposed that the nozzles 51 are arranged in a linear fashion at a uniform pitch (P), in the longitudinal direction of the head (main scanning direction).

When implementing the present invention, the arrangement structure of the nozzles is not limited to the example shown in the drawings, and it is also possible to apply various other types of nozzle arrangements, such as an arrangement structure in which nozzles are arranged in a row direction aligned with the main scanning direction and a column direction aligned with the sub-scanning direction.

In the present embodiment, a full line head having one or more nozzle row arranged through a length corresponding to the full width of the print medium in a direction substantially perpendicular to the conveyance direction of the print medium is described, but the scope of application of the present invention is not limited to this, and it is also possible to use a serial type (shuttle scanning type) of head which forms a row of dots aligned in the breadthways direction of the print medium, while moving a short head of a length that is smaller than the full width of the print medium.

Furthermore, in the present embodiment, a single-layer piezoelectric element having one piezoelectric body layer is described, but the present invention may also use a multiple-layer piezoelectric element in which two or more piezoelectric body layers are laminated together.

In the present embodiment, a mode is described in which the pressure plate 56 and the common electrode are combined, but it is also possible to provide the pressure plate 56 and the common electrode separately. In a mode in which the pressure plate 56 and the common electrode are provided separately, an insulating layer is provided between the pressure plate 56 and the common electrode, if a conductive material, such as a metallic material, is used as the pressure plate 56.

Description of Control System

Figure 5:
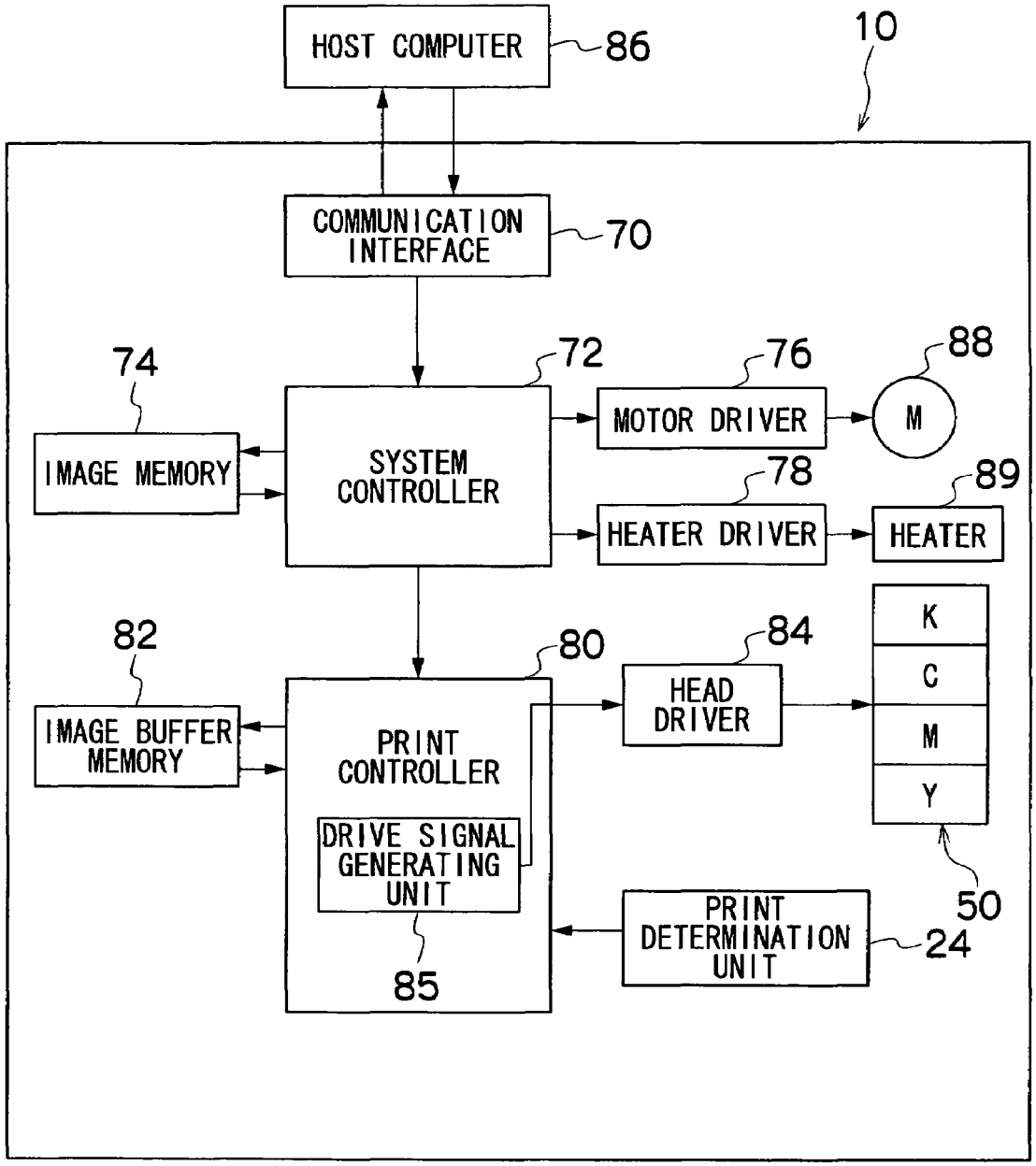
FIG. 5 is a principal block diagram showing the system composition of an inkjet recording apparatus according to the present embodiment.

FIG. 5 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller (a drive control device) 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74.

The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, image memory 74, motor driver 76, heater driver 78, and the like, as well as controlling communications with the host computer 86 and writing and reading to and from the image memory 74, and it also generates control signals for controlling the motor 88 and heater 89 of the conveyance system.

The program executed by the CPU of the system controller 72 and the various types of data which are required for control procedures are stored in the image memory 74. The image memory 74 may be a non-writeable storage device, or it may be a rewriteable storage device, such as an EEPROM. The image memory 74 is used as a temporary storage region for the image data, and it is also used as a program development region and a calculation work region for the CPU.

The motor driver 76 drives the motor 88 in accordance with commands from the system controller 72. The heater driver 78 drives the heater 89 of the post-drying unit 42 or the like in accordance with commands from the system controller 72.

The print controller 80 is a control unit having a signal processing function for performing various treatment processes, corrections, and the like, in accordance with the control implemented by the system controller 72, in order to generate a signal for controlling printing from the image data in the image memory 74. The print controller 80 supplies the print data thus generated to the head driver 84. Prescribed signal processing is carried out in the print controller 80, and the ejection amount and the ejection timing of the ink droplets from the print head 50 are controlled via the head driver 84 by means of a drive signal generated by a drive signal generating unit 85 on the basis of the image data. By this means, prescribed dot size and dot positions can be achieved. The details of the drive signal used in the inkjet recording apparatus 10 are described hereinafter.

The print controller 80 is provided with the image buffer memory 82; and image data, parameters, and other data are temporarily stored in the image buffer memory 82 when image data is processed in the print controller 80. The aspect shown in FIG. 5 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the piezoelectric elements of the heads of the respective colors 12K, 12C, 12M and 12Y on the basis of print data supplied by the print controller 80. The head driver 84 can be provided with a feedback control system for maintaining constant drive conditions for the print heads.

The image data to be printed is externally inputted through the communication interface 70, and is stored in the image memory 74. In this stage, the RGB image data is stored in the image memory 74.

The image data stored in the image memory 74 is sent to the print controller 80 through the system controller 72, and is converted to the dot data for each ink color in the print controller 80. In other words, the print controller 80 performs processing for converting the inputted RGB image data into dot data for four colors, K, C, M and Y. The dot data generated by the print controller 80 is stored in the image buffer memory 82.

The head driver 84 drives the actuators 58 of the print heads of the respective colors, 12K, 12C, 12M, 12Y, on the basis of print data supplied by the print controller 80. A feedback control system for maintaining constant drive conditions for the print heads may be included in the head driver 84.

Various control programs are stored in a program storage section (not shown), and a control program is read out and executed in accordance with commands from the system controller 72. The program storage section may use a semiconductor memory, such as a ROM, EEPROM, or a magnetic disk, or the like. An external interface may be provided, and a memory card or PC card may also be used. Naturally, a plurality of these storage media may also be provided.

The program storage section may also be combined with a storage device for storing operational parameters, and the like (not shown).

As shown in FIG. 1, the print determination unit 24 is a block including a line sensor, which reads in the image printed onto the recording paper 16, performs various signal processing operations, and the like, and determines the print situation (presence/absence of ejection, variation in droplet ejection, etc.), these determination results being supplied to the print controller 80.

The print controller 80 makes various corrections with respect to the head 50 on the basis of information obtained from the print determination unit 24.

In the example shown in FIG. 1, the print determination unit 24 is provided on the print surface side, the print surface is irradiated with a light source (not shown), such as a cold cathode fluorescent tube disposed in the vicinity of the line sensor, and the reflected light is read in by the line sensor. However, in implementing the present invention, another composition may be adopted.

Description of Drive Signal

Next, a drive signal used in the inkjet recording apparatus 10 will be described.

High-viscosity ink having a viscosity (approximately 10 cP to 15 cP) higher than that of generally used ink is used in the inkjet recording apparatus 10, and a composition is adopted whereby a minute amount of high-viscosity ink is ejected at a high ejection frequency (namely, a short ejection cycle).

Figure 6A:
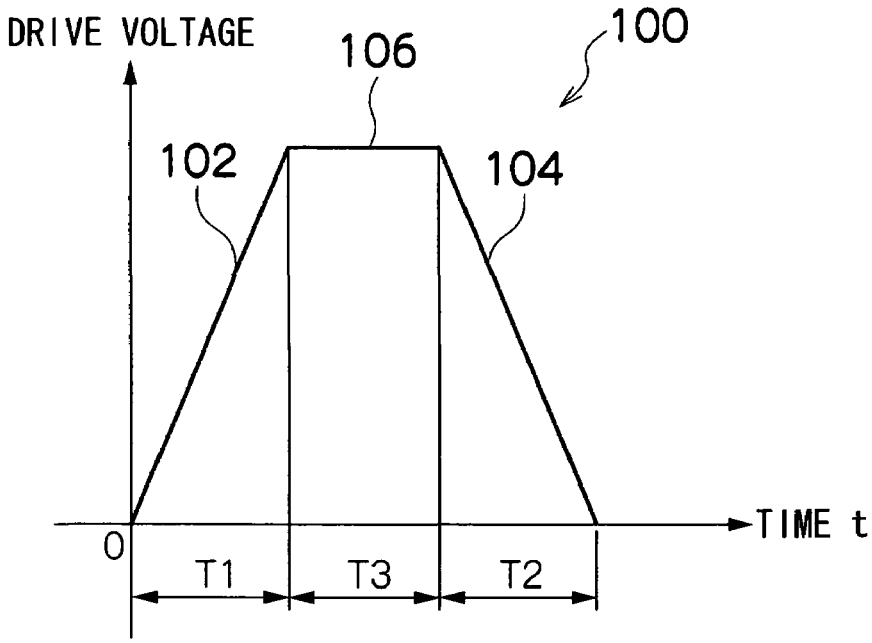
FIGS. 6A and 6B are diagrams showing a drive signal used in the inkjet recording apparatus shown in FIG. 1.

FIG. 6A shows the voltage waveform of a drive signal 100 applied to the actuator 58. The drive signal 100 comprises: a first drive signal 102 which causes the actuator 58 to operate in such a manner that the pressure plate 56 assumes a convex shape in the opposite direction from the nozzle 51, and thereby causes the pressure chamber 52 to expand from its static state; a second drive signal 104 which causes the actuator 58 to operate in such a manner that the convex-shaped pressure plate 56 projecting in the opposite direction to the nozzle 51 deforms in the direction of the nozzle 51, and thereby causes the pressure chamber 52 to contract (returning to its static state); and a third drive signal 106 which maintains the expanded state of the pressure chamber 52 caused to expand by the first drive signal 102.

The first drive signal 102 is a drive signal for pulling the actuator 58 during the time period T1, the second drive signal 104 is a drive signal for pushing the actuator 58 during the time period T2, and thus, the ink accommodated in the pressure chamber 52 is ejected from the nozzle 51 by pull-push driving which combines one pull operation and one push operation.

In other words, the first to third drive signals 102, 104 and 106 respectively have time periods of T1, T2 and T3. Also possible is a mode which omits the third drive signal 106.

The time period T2 of the second drive signal 104 shown in FIG. 6A is set in such a manner that the relationship between the time period T2 and the Helmholtz period (resonance period) Tc of the pressure chamber 52 satisfy the following relationship (1):

$$T2 \leqq Tc/2. \quad (1)$$

Desirably, the time period T2 of the second drive signal 104 is set to be as short as possible.

It is also preferable that the time periods T1, T2 and T3 and the Helmholtz period Tc of the pressure chamber 52 satisfy the following relationship (2):

$$T1+T2+T3 \leqq Tc/2. \quad (2)$$

By setting the whole of the time period of the drive signal 100 to ½ or less of the Helmholtz period Tc of the pressure chamber 52, it is possible to shorten the operation time period of the actuator 58 and to shorten the ejection cycle (in other words, to increase the ejection frequency).

It is also preferable that the time periods T1 and T3 and the Helmholtz period Tc of the pressure chamber 52 satisfy the following relationship (3):

$$T1+T3 \leqq Tc/2. \quad (3)$$

By setting the time period T2 of the second drive signal 104 to zero (in other words, making an instantaneous voltage change in the drive signal for contracting the pressure chamber 52 from its expanded state), it is possible to sever the liquid column in a reliable fashion during liquid ejection, and therefore, the liquid droplet ejection volume is further stabilized and the effect in prevent satellite droplets and trailing is further enhanced.

It is also preferable that the time period T3 and the Helmholtz period Tc of the pressure chamber 52 satisfy the following relationship (4):

$$T3 \leqq Tc/2. \quad (4)$$

By setting the time period T1 of the first drive signal 102 and the time period T2 of the second drive signal 104 both to zero (in other words, making an instantaneous voltage change in the drive signal for expanding the pressure chamber 52 from a static state and the drive signal for contracting the pressure chamber from an expanded state), the voltage waveform of the drive signal becomes a square wave. Therefore, not only is the waveform of the drive signal simplified, but furthermore, it also becomes possible to shorten the ejection cycle yet further.

In other words, desirably, the time period T2 of the second drive signal 104 approaches zero as far as possible. At the same time, the time period T1 of the first drive signal 102 is made as short as possible (namely, it approaches zero as far as possible), and thus a drive signal 120 having a square-shaped voltage waveform such as that shown in FIG. 6B may be adopted.

Figure 6B:
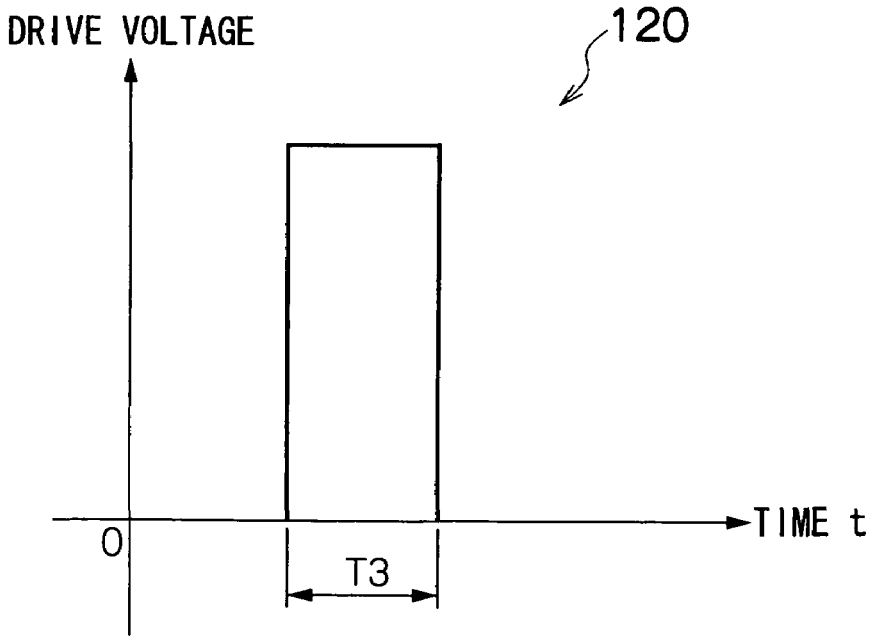

The drive voltage indicated in FIGS. 6A and 6B is an example, and since ink of an amount corresponding to the maximum voltage of the drive signal is ejected from the nozzle 51, the maximum voltage of the drive signal is set in accordance with the ink ejection amount. More specifically, if the ink ejection amount is small, then the maximum voltage is reduced, and if the ink ejection amount is large, then the maximum voltage is set to a high value.

Description of Pressure Generated in Pressure Chamber

Figure 7:
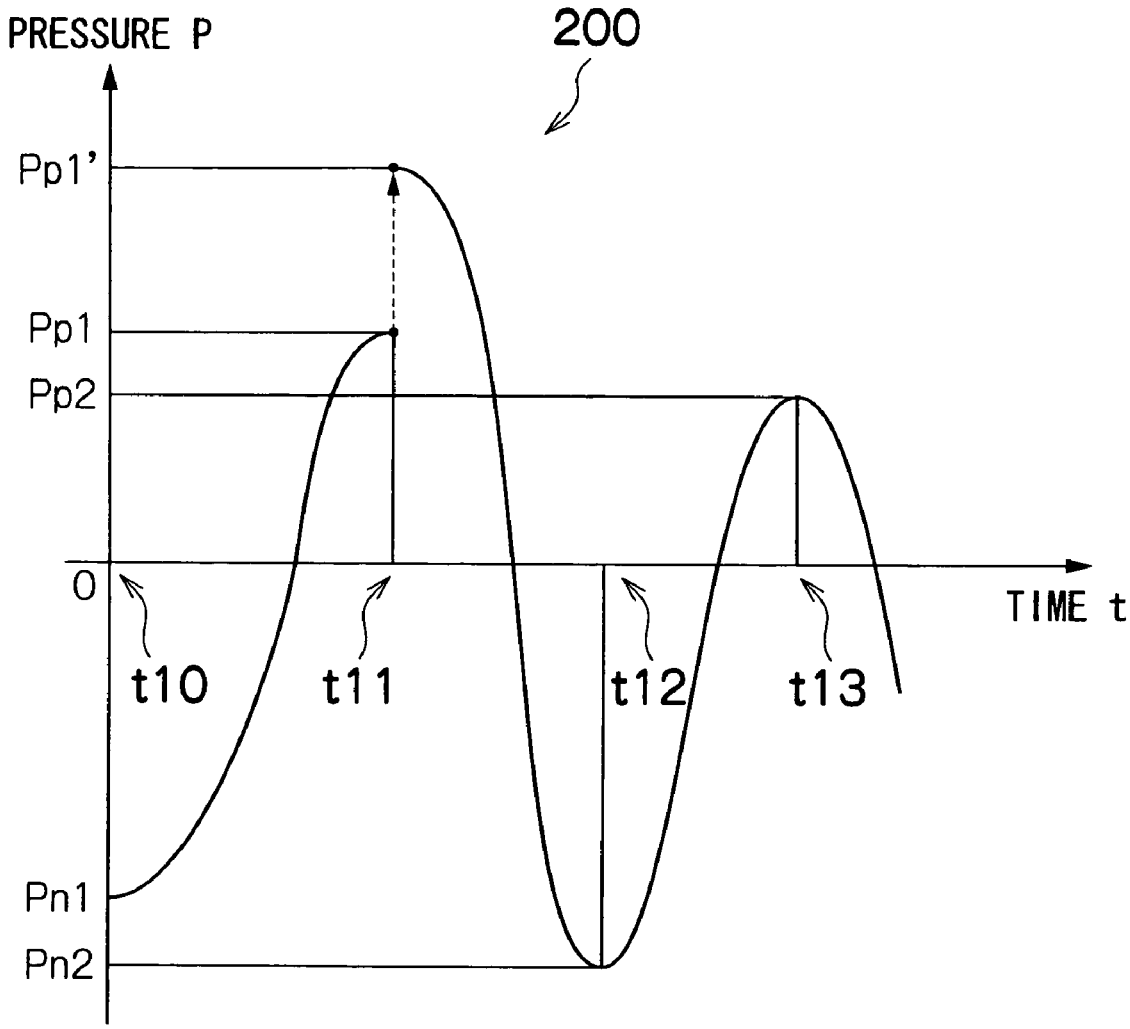
FIG. 7 is a diagram showing the waveform of the pressure generated in the nozzle section.

FIG. 7 shows the pressure waveform of the pressure 200 generated in the vicinity of the meniscus surface at the nozzle 51. In FIG. 7, the horizontal axis shows the time t, and the vertical axis shows the pressure P. Furthermore, the positive direction of the vertical axis (positive pressure) indicates the direction for ejecting ink to the outer side from the nozzle 51 (push direction), and the negative direction (negative pressure) indicates the direction for pulling the ink inside the pressure chamber 52 (pull direction).

When the drive signal 100 shown in FIG. 6A (or the drive signal 120 shown in FIG. 6B) is applied to the actuator 58, then a pressure 200 having a pressure waveform of a prescribed cycle as shown in FIG. 7 is generated at the nozzle 51 (meniscus surface).

More specifically, by means of the drive signal 100, negative pressure and positive pressure are generated alternately at the nozzle 51, as follows: firstly, a first negative pressure having a pressure value of Pn1; a first positive pressure having a pressure value of Pp1 (Pp1'), generated ½ cycle after the first negative pressure (timing t11); a second negative pressure having a pressure value of Pn2, generated one cycle after the first positive pressure; a second positive pressure having a pressure value Pp2, generated one cycle after the first positive pressure (½ cycle after the second negative pressure); and so on.

At timing t11, the pressure P changes in a non-continuous fashion, and the pressure generated inside the nozzle 51 jumps from Pp1 to Pp1', indicating that ink is ejected to the exterior of the nozzle 51 at this timing.

At the pressure generated in the nozzle 51 in this way, the relationship between the absolute value |Pn1| of the first negative pressure (the pressure at timing t10) and the absolute value |Pn2| of the second negative pressure (the pressure at timing t12 ) satisfies the following relationship (5):

$$|Pn1| \leqq |Pn2|. \quad (5)$$

More specifically, by making the absolute value of the second negative pressure greater than the absolute value of the first negative pressure, the liquid column (ink column) is severed reliably during ink ejection and the ejection amount is stable, even if the ejection amount is very small. Furthermore, it is possible to prevent satellite drops and smearing.

On the other hand, the relationship between the absolute value |Pp2| of the second positive pressure (the pressure at timing t13) and the absolute value |Pn1| of the first negative pressure (the pressure at timing t10) satisfies the following relationship (6):

$$|Pn1| \geqq |Pp2|. \quad (6)$$

In this way, by adopting a composition whereby the pressure in the nozzles 51 changes so as to satisfy the relationship (6), vibration of the meniscus after ejection is suppressed and ink can be ejected continuously at a high ejection frequency.

Furthermore, a special drive signal, such as a drive signal for static driving of the meniscus is not required, and therefore the composition of the drive signals becomes simplified. In the present embodiment, firstly, a negative pressure is generated at the nozzle 51 by causing the pressure chamber 52 to expand, but it is also possible to generate a positive pressure at the nozzle 51 by contracting the pressure chamber 52, firstly, before the first negative pressure.

Detailed Structure of Ink Chamber Unit

Next, the structure of the ink chamber unit 53 shown in FIG. 4 will be described in detail.

The print head 50 is composed in such a manner that a prescribed ejection frequency can be achieved by performing a pull and push action utilizing the resonance between the contractibility (compliance) of the pressure chamber 52 and the inertia (inertance) of the supply side flow channel including the nozzle 51 and the ink supply port 54 (hereafter, this may be referred to simply as the ink supply port 54).

Figure 8:
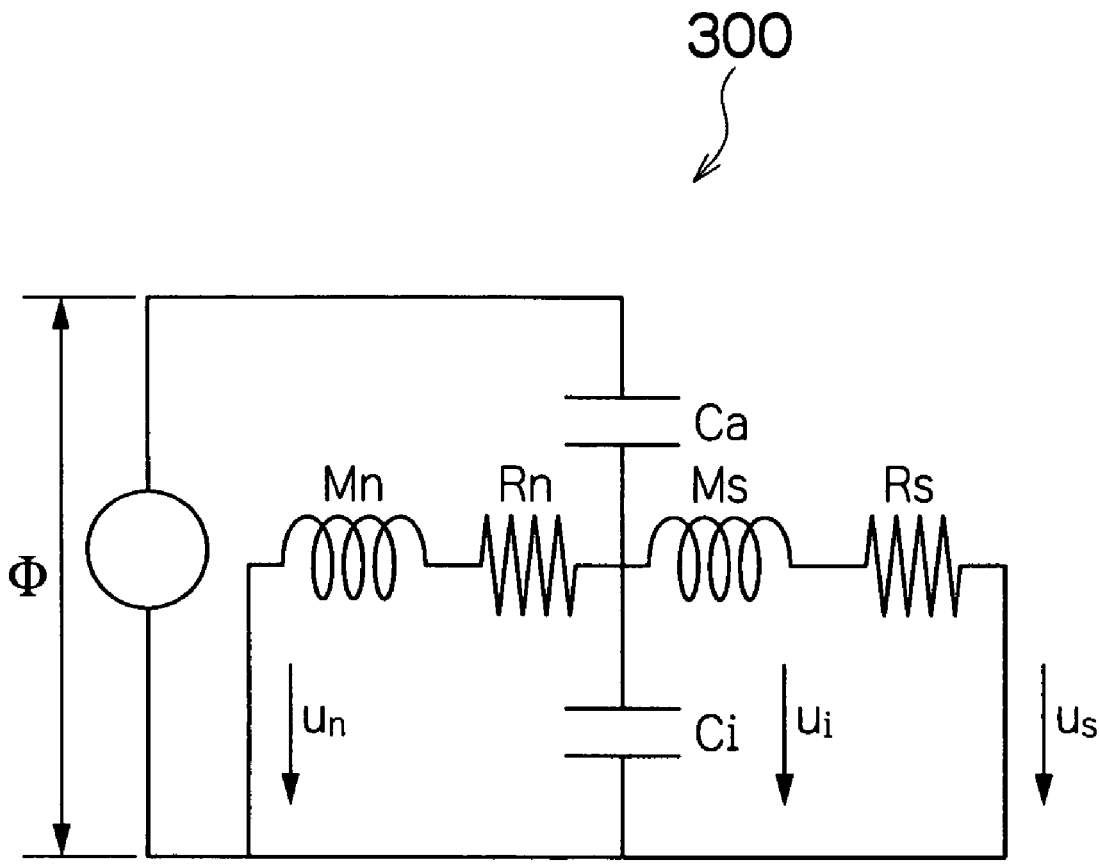
FIG. 8 is a diagram showing a lumped constant model of the print head shown in FIGS. 3A to 3C.

FIG. 8 shows a lumped constant model (lumped constant circuit) 300 in a case where the functions (characteristics) of the ink chamber unit 53 shown in FIG. 4 has been replaced with an electrical circuit.

The lumped constant model 300 shown in FIG. 8 comprises the inertance Mn of the nozzle 51, the fluid resistance Rn of the nozzle 51, the compliance Cn due to the surface tension in the nozzle section, the inertance Ms of the ink supply port 54, the fluid resistance Rs of the ink supply port 54, the compliance Ca of the actuator 58, and the pressure differential (the pressure applied to the whole system when the actuator 58 is operated) $\phi$. Furthermore, un is the volumetric speed of the ink inside the nozzle 51, ui is the volumetric speed of the ink inside the pressure chamber 52, and us indicates the volumetric speed of the ink inside the ink supply port 54.

In the lumped constant model 300 shown in FIG. 8, taking the ink density to be $\rho$, the ink viscosity, to be v, the ink surface tension, to be $\sigma$, the flow channel length of the nozzle 51 (shown in FIG. 4), to be ln, the (cross-sectional) surface area of the nozzle 51, to be An, the radius of the nozzle 51, to be rn (FIG. 4 shows the diameter Dn of the nozzle 51), the flow channel length of the ink supply port 54 (shown in FIG. 4), to be ls, the (cross-sectional) surface area of the ink supply port 54, to be As, the speed of sound in the ink, to be c, and the pressure generated by the actuator 58 when the removed volume is V, to be P, then the values of the inertance Mn of the nozzle 51, the resistance Rn of the nozzle 51, the compliance Cn due to the surface tension at the nozzle 51, the inertance Ms of the ink supply port 54, the resistance Rs of the ink supply port 54, the compliance Ci of the pressure chamber 52, and the compliance Ca of the actuator 58, are expressed by the following formulas (7) to (12):

$$Mn = \rho \times \frac{\ln}{An}; \tag{7}$$

$$Rn = 8 \times \pi \times \nu \times \frac{\ln}{An^2}; \tag{8}$$

$$Ms = \rho \times \frac{ls}{As}; \tag{9}$$

$$Rs = 8 \times \pi \times \nu \times \frac{ls}{As^2}; \tag{10}$$

$$Ci = \frac{V}{\rho \times c^2}; \text{ and} \tag{11}$$

$$Ca = \frac{X}{P}. \tag{12}$$

The compliance Cn due to the surface tension at the nozzle 51 is sufficiently small compared to the compliance Ci of the pressure chamber 52 and hence this capacitance component is virtually negligible. Therefore, Cn is omitted from the system shown by the lumped constant model 300 in FIG. 8.

Furthermore, the removed volume X is the sum total (V1+V2+V3) of the volume of ink V1 ejected to the exterior from the nozzle 51, the volume of ink V2 returning to the supply side, and the volume of ink V3 compressed due to application of pressure.

Here, the differential equation of the lumped constant model 300 shown in FIG. 8 is expressed by the following formulas (13) to (15), using the volumetric speed of the ink inside the nozzle 51, un, the volumetric speed of the ink inside the pressure chamber 52, ui, the volumetric speed of the ink inside the ink supply port 54, us, and the formulas (7) to (12):

$$\Phi = \frac{4}{Ca} \times \int (un + ui + us)dt + \frac{1}{Ci} \times \int uidt; \tag{13}$$

$$\frac{1}{Ci} \times \int uidt = Rn \times un + Mn \times \frac{dun}{dt}; \text{ and} \tag{14}$$

$$\frac{1}{Ci} \times \int uidt = Rs \times us + Ms \times \frac{dus}{dt}. \tag{15}$$

The pressure Pn applied at the nozzle 51 (the force obtained due to the action of the inertance Mn of the nozzle 51 and the fluid resistance Rn of the nozzle 51) is expressed by the following formula (16):

$$Pn = Rn \times un + Mn \times \frac{dun}{dt}. \tag{16}$$

If the drive signal is set to a condition whereby the maximum ejection force is obtained due to pull-push driving by means of a drive signal having a square-shaped voltage waveform as shown in FIG. 6B (in other words, resonance conditions of the pressure wave), then the volumetric speed of the ink inside the nozzle 51, un, is expressed by the following formula (17):

$$un = \frac{Ca \times P_0}{Mn \times C \times E} \times \exp(-D \times t) \times \sin(E \times t). \tag{17}$$

Figure 9A:
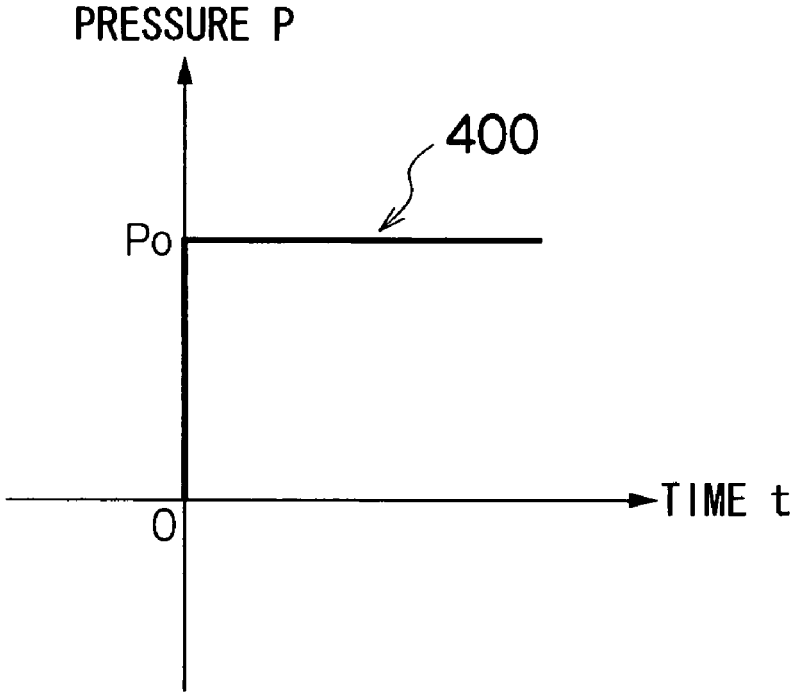
FIGS. 9A and 9B are diagrams showing the input pressure when determining the speed of the ink inside the nozzle.

The formula (17) shows the volumetric speed, un, of the ink inside the nozzle 51 in the case of the step input pressure 400 shown in FIG. 9A. C, D, and E are expressed as follows:

$$C = Ca + Ci; \tag{18}$$

$$D = \frac{R}{2 \times M}; \text{ and} \tag{19}$$

$$E = \frac{1}{2 \times C \times M} \times \sqrt{4 \times M \times C - R^2 \times C^2}. \tag{20}$$

Here, M and R in the formulas (19) and (20) are constants which satisfy the following formulas:

$$M = \frac{Mn \times Ms}{Mn + Ms}; \text{ and} \tag{21}$$

$$R = \frac{Rn \times Rs}{Rn + Rs}. \tag{22}$$

In other words, as shown in the formula (17), the volumetric speed, un, of the ink inside the nozzle 51 during pull-push driving using the drive waveform 120 having a square-shaped voltage waveform shown in FIG. 6B is expressed as a function of time t, and the pressure Pn applied to the nozzle 51 can be expressed as a function of time t on the basis of the volumetric speed, un, of the ink inside the nozzle 51, as shown in the following formulas (23) and (24):

$$Pn(t) = \frac{Ca \times P_0}{C \times E} \times \{-D \times \sin(E \times t) - E \times \sin(E \times t)\}\exp(-D \times t)\left(\text{when } 0 < t < \frac{\pi}{E}\right); \text{ and} \tag{23}$$

$$Pn(t) = \frac{Ca \times P_0}{C \times E} \times \left\{1 + \exp\left(\frac{D \times \pi}{E}\right)\right\} \times \{-D \times \sin(E \times t) - E \times \sin(E \times t)\} \times \exp(-D \times t)\left(\text{when } \frac{\pi}{E} \le t\right). \tag{24}$$

The volumetric speed, un, of the ink inside the nozzle 51 can be determined by means of a commonly known calculation method, and therefore, description of the method for calculating the volumetric speed, un, of the ink inside the nozzle 51 is omitted from the present specification.

Figure 9B:
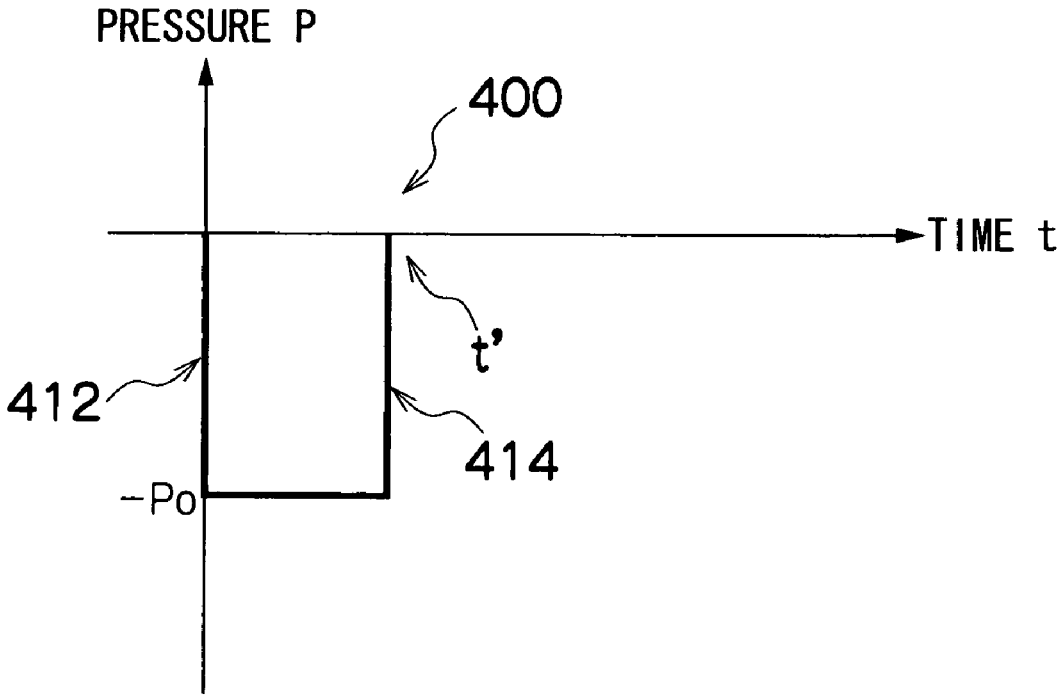

FIG. 9B shows the ideal pressure (pressure waveform) 410 generated by the drive waveform 120. In FIG. 9B, pressure generated in the pull direction is taken to be the negative direction.

Here, in the pressure waveform 410, if the pressure waveform 414 in the push direction is delayed in phase by ½ of the vibration period with respect to the pressure waveform 412 in the pull direction, then these waveforms reinforce each other (namely, they resonate), and therefore a maximum ejection force can be obtained.

The value $P_0$ in FIGS. 9A and 9B, and the formulas (17), (23) and (24) indicates the magnitude of the pressure applied to the whole system when the actuator 58 is driven (this magnitude corresponding to the absolute value of Φ shown in FIG. 1).

By studying the change in P(t) per unit time on the basis of the formulas (23) and (24), then taking n to be an integer, it can be seen that turning points are obtained at $$t = n \times \frac{\pi}{E}.$$

Supposing that n=0 to 3, this situation can be expressed by the following formulas:

$$P(0) = -\frac{Ca \times P_0}{C}; \tag{25}$$

$$P\left(\frac{\pi}{E}\right) = \frac{Ca \times P_0}{C} \times \left\{1 + \exp\left(\frac{D \times \pi}{E}\right)\right\} \times \exp\left(-\frac{D \times \pi}{E}\right); \tag{26}$$

$$P\left(\frac{2 \times \pi}{E}\right) = -\frac{Ca \times P_0}{C} \times \left\{1 + \exp\left(\frac{D \times \pi}{E}\right)\right\} \times \exp\left(-\frac{2 \times D \times \pi}{E}\right); \text{ and} \tag{27}$$

$$P\left(\frac{3 \times \pi}{E}\right) = \frac{Ca \times P_0}{C} \times \left\{1 + \exp\left(\frac{D \times \pi}{E}\right)\right\} \times \exp\left(-\frac{3 \times D \times \pi}{E}\right). \tag{28}$$

The formulas (25) to (28) correspond to the respective pressures P1, P2 (P2'), P3 and P4 at timings t10 to t13 shown in FIG. 7.

Here, from analysis of simulations based on CFD (finite element analysis), the conditions for ejecting very small amounts of ink at high speed satisfy the following formulas:

$$|P(0)| \le P\left(\frac{2 \times \pi}{E}\right); \text{ and} \tag{29}$$

$$|P(0)| \ge P\left(\frac{3 \times \pi}{E}\right). \tag{30}$$

In other words, the formula (29) indicates that the negative pressure for pulling back the ink column (liquid column) formed during ink ejection is high, and the formula (30) indicates that the pressure attenuation is high in order that there is no vibration of the meniscus surface after ink ejection. The formulas (29) and (30) can be expressed as follows:

$$1 \le \exp\left(-\frac{D \times \pi}{E}\right) + \exp\left(-\frac{2 \times D \times \pi}{E}\right); \text{ and} \tag{31}$$

$$1 \ge \exp\left(-\frac{2 \times D \times \pi}{E}\right) + \exp\left(-\frac{3 \times D \times \pi}{E}\right). \tag{32}$$

By solving the formulas (31) and (32) in numerical terms (by determining the definitive values of D and E), then the relationship indicated by the following formula (33) is obtained:

$$-0.4811 \le -\frac{D \times \pi}{E} \le -0.2813. \tag{33}$$

By rearranging the formula (33), the relationship of the following formula (34) is obtained:

$$\frac{\left(\frac{0.4811}{\pi}\right)^2 \times \frac{\rho}{\ln \times As + ls \times An}}{\left\{1 + \left(\frac{0.4811}{\pi}\right)^2\right\} \times \left(\frac{V}{\rho \times c^2} + \frac{X}{P}\right)} \ge \frac{2 \times \pi \times v}{\ln \times As^2 + ls \times An^2} \ge \frac{\left(\frac{0.2813}{\pi}\right)^2 \times \frac{\rho}{\ln \times As + ls \times An}}{\left\{1 + \left(\frac{0.2813}{\pi}\right)^2\right\} \times \left(\frac{V}{\rho \times c^2} + \frac{X}{P}\right)}. \tag{34}$$

In the print head 50 having the composition described above, if the conditions of the nozzle 51, pressure chamber 52 and ink supply port 54 stated in the formula (1) are satisfied, then it is possible to eject very small amounts of ink in a stable fashion, by means of a drive signal having a pull-push action only, and furthermore, residual vibration of the pressure wave generated after ejection can be damped rapidly. Therefore, it is not necessary to apply a drive signal to the actuator 58 in order to stabilize the meniscus, and thus stable ink ejection at a high ejection frequency can be achieved.

In the foregoing description, an inkjet recording apparatus has been described as one example of a liquid ejection apparatus, but the scope of the present invention is not limited to this and it may also be applied to various other types of image forming apparatuses and liquid ejection apparatuses which form three-dimensional shapes on an ejection receiving medium by ejecting liquid onto the ejection receiving medium.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

a nozzle through which liquid is ejected;

a pressure chamber which accommodates the liquid to be ejected from the nozzle;

a supply side flow path which fills the liquid from a supply system into the pressure chamber;

an actuator which is provided on at least one wall of the pressure chamber and changes a volume of the pressure chamber; and a drive signal generating device which generates a drive signal including at least a first drive signal having a time period T1 which drives the actuator so as to expand the pressure chamber, and a second drive signal having a time period T2 which drives the actuator so as to contract the pressure chamber, wherein:

a relationship between the time period T2 of the second drive signal and a Helmholtz period Tc of the pressure chamber satisfies T2≦Tc/2; and when the actuator is operated by means of the drive signal to generate, in the nozzle, a pressure having a prescribed cycle in which a negative pressure acting in a direction which causes the pressure chamber to expand, and a positive pressure acting in a direction which causes the pressure chamber to contract arise alternately, a relationship between an absolute value of a first negative pressure Pn1 generated initially from a static meniscus state of the liquid in the nozzle and an absolute value of a second negative pressure Pn2 generated one cycle after the first negative pressure, satisfies |Pn1|≦|Pn2|, wherein the following relationship is satisfied $$\frac{\left(\frac{0.4811}{\pi}\right)^2 \times \frac{\rho}{\ln \times As + ls \times An}}{\left\{1 + \left(\frac{0.4811}{\pi}\right)^2\right\} \times \left(\frac{V}{\rho \times c^2} + \frac{X}{P}\right)} \geq \frac{2 \times \pi \times v}{\ln \times As^2 + ls \times An^2} \geq \frac{\left(\frac{0.2813}{\pi}\right)^2 \times \frac{\rho}{\ln \times As + ls \times An}}{\left\{1 + \left(\frac{0.2813}{\pi}\right)^2\right\} \times \left(\frac{V}{\rho \times c^2} + \frac{X}{P}\right)}$$

where ln is a length of the nozzle; An is a surface area of the nozzle; ls is a length of the supply side flow path; As is a surface area of the supply side flow path; ρ is a density of the liquid; v is a viscosity of the liquid; c is a speed of sound in the liquid; V is a removed volume of the liquid accommodated in the pressure chamber when a pressure P is generated by the actuator; and X is a removed volume of total of a volume of the liquid ejected from the nozzle, a volume of the liquid returning to the supply side flow path, and a volume of the liquid compressed due to application of the pressure P.

2. The liquid ejection apparatus as defined in claim 1, wherein a relationship between the absolute value of the first negative pressure Pn1, and an absolute value of a second positive pressure Pp2 generated after the second negative pressure by a half of the prescribed cycle, satisfies |Pn1|≧|Pp2|.

3. The liquid ejection apparatus as defined in claim 1, wherein:

the drive signal includes a third drive signal having a time period T3 which maintains an expanded state of the pressure chamber; and a relationship between the time period T1 of the first drive signal, the time period T2 of the second drive signal, the time period T3 of the third drive signal, and the Helmholtz period Tc of the pressure chamber, satisfies T1+T2+T3≦Tc/2.

4. The liquid ejection apparatus as defined in claim 1, wherein:

the drive signal includes a third drive signal having a time period T3 which maintains an expanded state of the pressure chamber; and a relationship between the time period T1 of the first drive signal, the time period T3 of the third drive signal, and the Helmholtz period Tc of the pressure chamber, satisfies T1+T3≦Tc/2.

5. The liquid ejection apparatus as defined in claim 1, wherein:

the drive signal includes a third drive signal having a time period T3 which maintains an expanded state of the pressure chamber; and a relationship between the time period T3 of the third drive signal, and the Helmholtz period Tc of the pressure chamber, satisfies T3≦Tc/2.

6. The liquid ejection apparatus as defined in claim 1, wherein the liquid of a viscosity of at least 10 cP is ejected from the nozzle.

* * * * *